US007884768B2

(12) United States Patent
Navarro et al.

(10) Patent No.: US 7,884,768 B2
(45) Date of Patent: Feb. 8, 2011

(54) COMPACT, DUAL-BEAM PHASED ARRAY ANTENNA ARCHITECTURE

(75) Inventors: Julio A. Navarro, Kent, WA (US); Peter T. Heisen, Kent, WA (US); Scott A. Raby, Redmond, WA (US); Ming Chen, Bellevue, WA (US); Lixin Cai, Ravensdale, WA (US)

(73) Assignee: The Boeing Company, Chicago, IL (US)

( * ) Notice: Subject to any disclaimer, the term of this patent is extended or adjusted under 35 U.S.C. 154(b) by 961 days.

(21) Appl. No.: 11/594,388

(22) Filed: Nov. 8, 2006

(65) Prior Publication Data

US 2008/0106484 A1 May 8, 2008

(51) Int. Cl.
*H01Q 1/24* (2006.01)

(52) U.S. Cl. ..... 343/702; 343/853

(58) Field of Classification Search ..... 343/700 MS, 343/778, 846, 844, 853, 702
See application file for complete search history.

(56) References Cited

U.S. PATENT DOCUMENTS 5,276,455 A 1/1994 Fitzsimmons et al.
5,886,671 A 3/1999 Riemer et al.
6,424,313 B1 7/2002 Navarro et al.
6,580,402 B2 6/2003 Navarro et al.
6,670,930 B2 12/2003 Navarro
6,900,765 B2 5/2005 Navarro et al.
6,989,791 B2 1/2006 Navarro et al.
7,289,078 B2 10/2007 Navarro

*Primary Examiner*—Michael C Wimer
(74) *Attorney, Agent, or Firm*—Harness, Dickey & Pierce, P.L.C.

(57) ABSTRACT

A dual beam electronically scanned phased array antenna architecture including a plurality of antenna modules orthogonally connected to a signal distribution board. Each module includes a radiator board orthogonally connected to a first end of a support mandrel. Each radiator board includes RF radiators and a pair of chip carriers mounted to opposing sides of the respective mandrel and interconnected to the respective radiator board. Each module includes a signal transfer board formed to fit around a second end of the mandrel such that it is compressed between the mandrel and the signal distribution board, and a pair of signal distribution bridges mounted to the opposing sides of the mandrel. Each signal distribution bridge interconnects respective chip carriers with the signal transfer board and distributes digital, DC and/or RE signals received from the signal transfer board to a plurality of beam scanning circuits included in the respective chip carrier.

26 Claims, 6 Drawing Sheets

COMPACT, DUAL-BEAM PHASED ARRAY ANTENNA ARCHITECTURE

GOVERNMENT RIGHTS IN THE INVENTION

This invention was made with Government support under contract MBA N00014-02-C-0068, awarded by the United States Navy. The Government has certain rights in this invention.

FIELD

This invention relates to electronically scanned antennas, and more particularly to compact, low-profile architecture for electronically scanned antennas.

BACKGROUND

The statements in this section merely provide background information related to the present disclosure and may not constitute prior art.

Electronically-scanned antennas (ESAs) combine a wide range of electrical and mechanical functions to produce agile directional beam steering. ESAs require complex radio frequency (RF) distribution networks as well as direct current (DC) power and logic that must be routed to the typical unit cell. The unit cell is the building block of an ESA comprised of amplification, attenuation, phase-shifting, logic control, etc., and serves as the point of contact to free-space through a radiating element. For full-duplex communication applications, the unit cell provides either a transmit or a receive function. The unit cell functions of the specific antenna application, e.g., power out, phase shifting, attenuation, control, etc., generally define the number, type and dimensions of the unit cell beam scanning electronic elements required. Depending on the operating frequency, scanning angle and type of function of the specific antenna application, the required beam scanning electronic elements may require more or less space and area that directly affect the size of the unit cell and more importantly, the size of the antenna face, i.e., the antenna aperture.

The ESA scanning performance is directly dependent upon the array lattice dimensions. Typically, the radiating element array lattice dictates the general geometry of the unit cells. Thus, based on the desired antenna performance requirements for the specific application, the larger the radiating element array lattice and the more complex the desired antenna specifications, the greater the number of beam steering electronics and the tighter the packing of the associated unit cells. This significantly affects the cost and manufacturability of the ESA. Various cost-saving measures have been employed to reduce such incurred costs. For example, thinning the number and randomizing the unit cell orientations and locations have been employed to reduce the number of unit cells and their packing density, while maintaining acceptable scanning properties of the ESA. The number of elements, geometry and packing density of the radiating element array lattice are directly dependent on the desired beam scanning properties of the ESA. The tighter the lattice, the better the ESA will scan. It has been established that a half-wavelength spacing between the radiating elements at the upper end of a typical operating bandwidth provides excellent beam steering performance, but requires greater packaging complexity.

To enable more functions, wider scanning requirements and higher operating frequencies of an ESA, unit cell packaging solutions are required that address such things as radiation performance over bandwidth; vertical transition fabrication, assembly and reproducibility; DC power distribution (e.g., V+, V− power planes); logic control distribution (e.g., data and clock); RF distribution for wider instantaneous bandwidths; efficient thermal management of the unit cells; mechanical integrity and robustness of the unit cells under shock, vibration, and environmentally harsh conditions (e.g., humidity, salt fog, etc). Some efforts to integrate functions and reduce the overall parts count and cost have resulted in multi-element module architectures. However, due to the increased complexity of the number of beam steering elements needed in the unit cells, such known architectures require gaps between radiating elements that are larger than the aforementioned half-wavelength spacing. Thus, beam steering performance is greatly degraded Accordingly, there is a need for a packaging architecture for a phased array antenna module which permits even closer radiating element spacing to be achieved, and which allows for even simpler and more cost efficient manufacturing processes to be employed to produce a phased array antenna.

SUMMARY

A dual beam electronically scanned phased array antenna architecture is provided. In accordance with various embodiments, the architecture includes a plurality of antenna modules substantially orthogonally connected to a signal distribution board. Each module includes a radiator board substantially orthogonally connected to a first end of a support mandrel. Each radiator board includes a plurality of radio frequency (RF) radiating elements. Each module additionally includes pair of chip carriers mounted to opposing sides of the respective mandrel and interconnected to the respective radiator board. Furthermore, each module includes a signal transfer board formed to fit around a second end of the mandrel such that the signal transfer board is compressed between the mandrel and the signal distribution board. Each module further includes a pair of signal distribution bridges mounted to the opposing sides of the mandrel. Each signal distribution bridge interconnects the respective chip carriers with the signal transfer board and distributes digital, DC and/or RF signals received from the signal transfer board to a plurality of beam scanning circuits included in the respective chip carrier. The orthogonal relationship between the RF radiating elements and the beam scanning circuits allow the modules to be connected to the signal distribution board in close proximity to each other such that the RF radiating elements of adjacent modules have a spacing of one-half wavelength or less. Therefore, a high frequency, dual beam electronically scanned phased array antenna can be constructed that is capable of having scanning angles of 60° or greater. Therefore, a high frequency, dual beam electronically scanned phased array antenna can be constructed that is capable of having very wide scanning angles without introducing grating lobes.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

DETAILED DESCRIPTION

Figure 1:
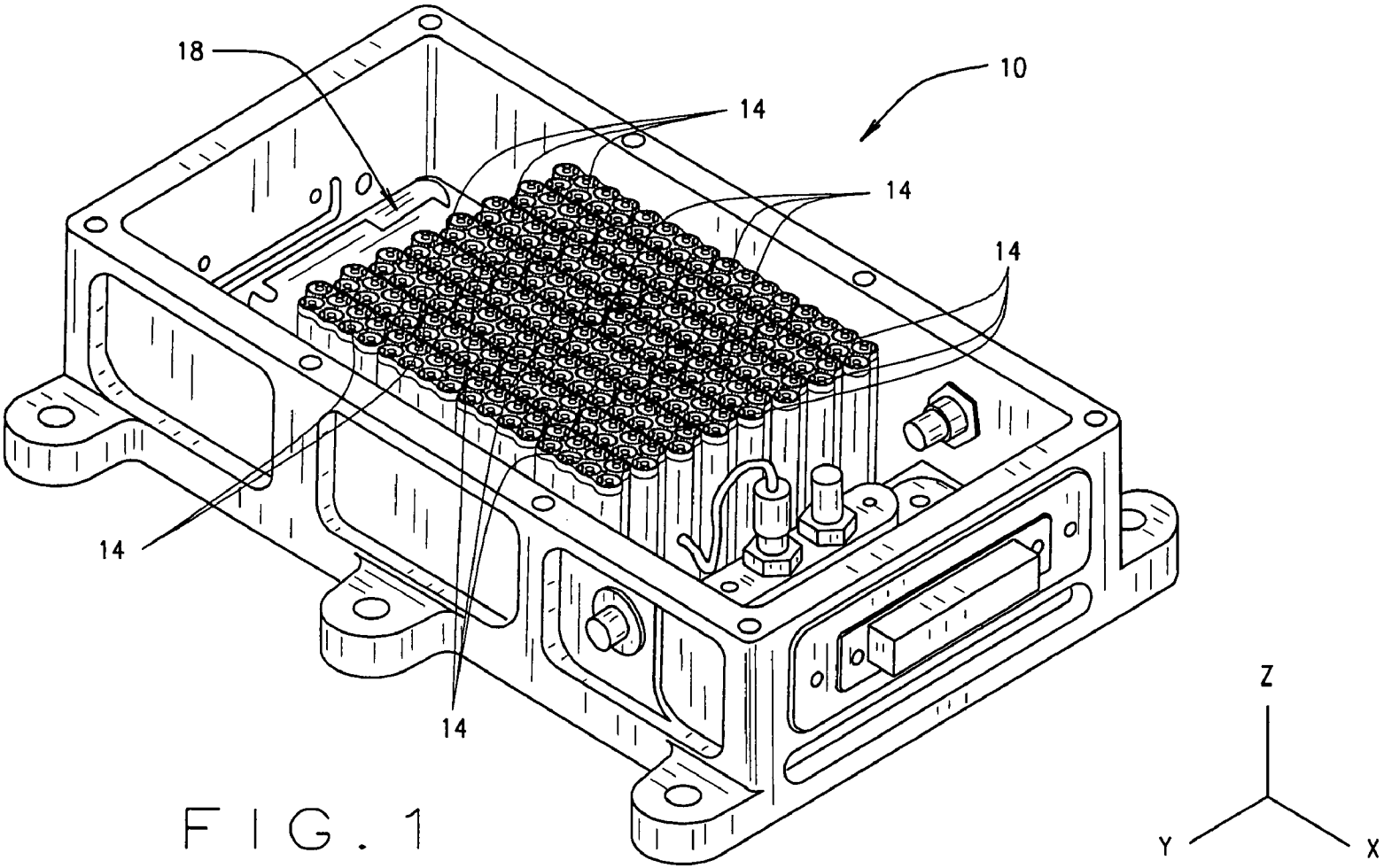
FIG. 1 is an isometric view of an electronically scanned phased array antenna with a top cover removed to illustrate a plurality of antenna modules included therein, in accordance with various embodiments of the present disclosure.

The following description is merely exemplary in nature and is in no way intended to limit the present teachings, application, or uses. Throughout this specification, like reference numerals will be used to refer to like elements.

Referring to FIG. 1, an electronically scanned phased array antenna 10 with a top cover removed to illustrate a plurality of antenna modules 14 included therein, in accordance with various embodiments of the present disclosure. As illustrated, the antenna modules 14 are tightly packed into an array 18 such that each module 14 is in very close proximity to all adjacent modules 14. The dimensions of the antenna modules 14 allow for readily repeatable and manufacturable processes. As will be understood from the description below, the ability to tightly pack the array is made possible by the 'vertical' or 'Z-axis' architecture of the modules 14. Moreover, by tightly packing the modules 14 in such close proximity to each other, as described herein, the antenna 10 can form a dual beam, high frequency electronically scanned phased array antenna capable of providing a very wide range of scanning angles. For example, as will become clear, the antenna 10 incorporating the modules 14 having the architecture described below is capable of substantially simultaneously transmitting two independent high frequency radio frequency (RF) beams having a scanning angle from 0° to approximately 80° . Furthermore, although the antenna 10 and the antenna modules 14 will generally be described herein in reference to a transmit operational mode, it should be clearly understood that the modules 14, and thus the antenna 10, can be operated in a transmit and/or a receive operational mode.

Figure 2:
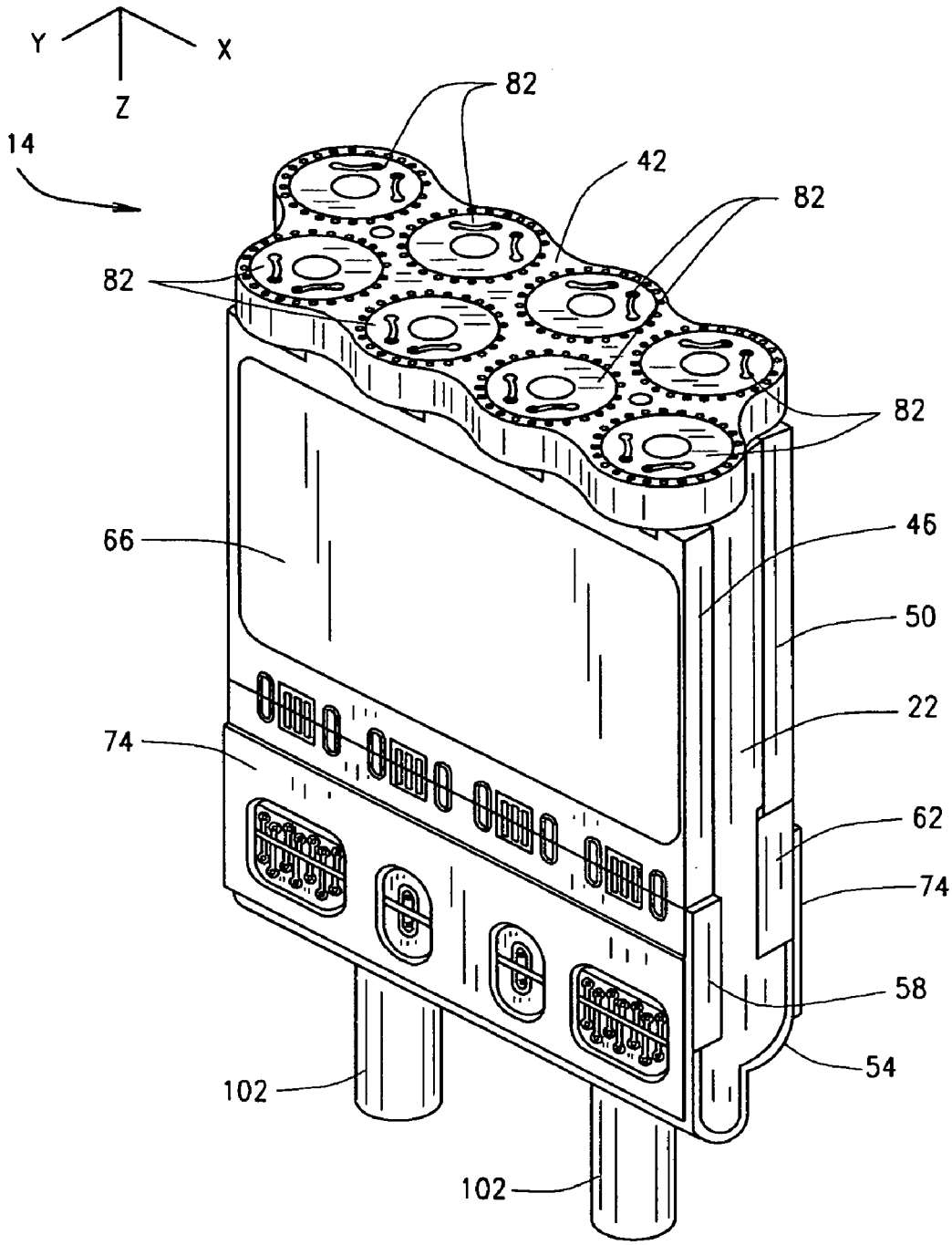
FIG. 2 is an isometric view of one the antenna modules shown in FIG. 1, in accordance with various embodiments of the present disclosure.
Figure 3:
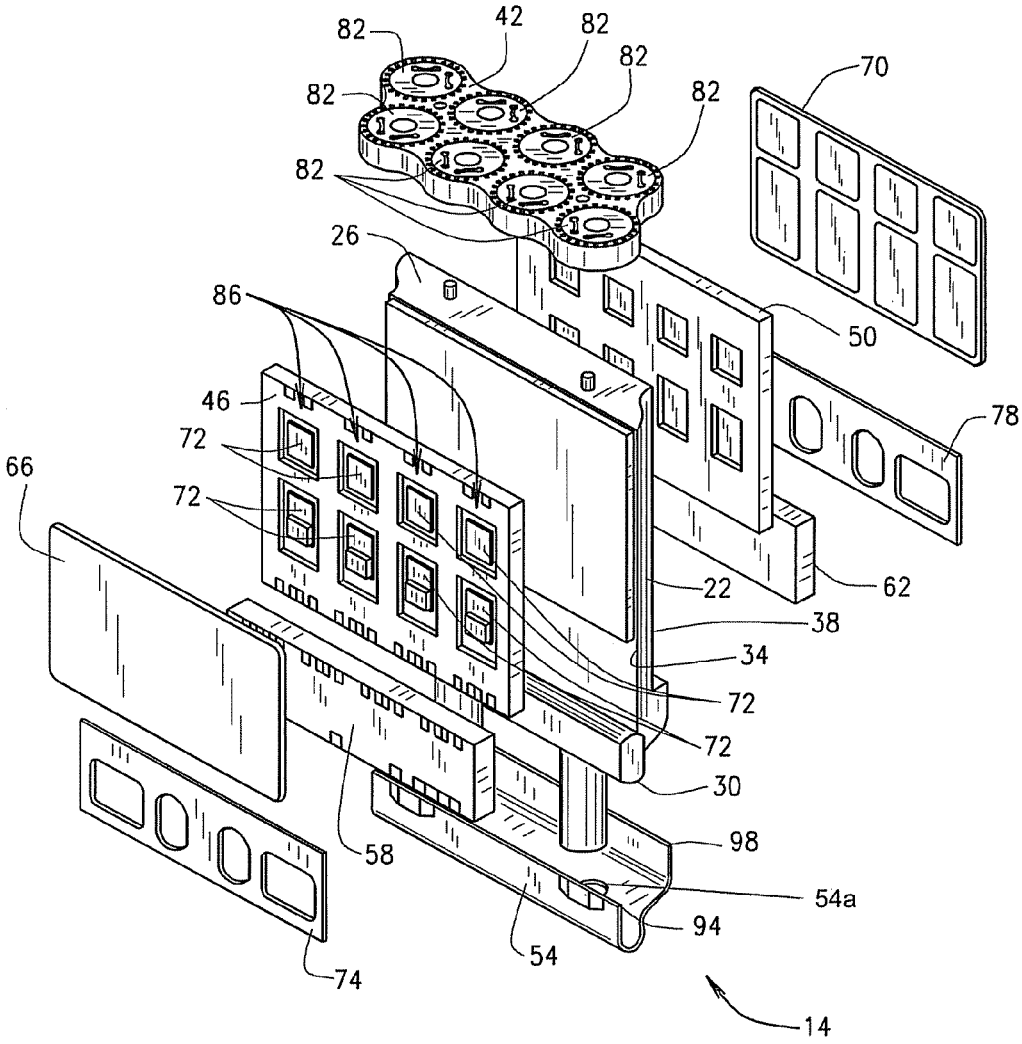
FIG. 3 is an exploded view of one of the antenna modules shown in FIG. 1, in accordance with various embodiments of the present disclosure.

Referring now to FIGS. 2 and 3, the architecture and construction of each module 14 will now be described. It should be understood that although the antenna 10 includes a plurality of modules 14, all modules 14 are substantially identical, thus, for clarity and simplicity, the description and figures herein will often simply reference a single module 14. Each module 14 includes a support mandrel 22 to which all the components, described below, are mounted or attached. The mandrel 22 includes a first, or top, end 26, an opposing second, or bottom, end 30 a first side 34 and an opposing second side 38. Each module 14 additionally includes a radiator board 42 mounted to the top end 26 of the mandrel 22, a first and a second chip carrier 46 and 50 respectively mounted to the first and second sides 34 and 38 of the mandrel 22, and a signal transfer board 54 mounted to the bottom end 30 of the mandrel 22. Furthermore, each module 14 includes a first signal distribution bridge 58 mounted to the first side 34 of the mandrel 22 between the first chip carrier 46 and signal transfer board 54, and a second signal distribution bridge 62 mounted to the second side 38 of the mandrel 22 between the second chip carrier 50 and signal transfer board 54.

In accordance with various embodiments, each module 14 includes a first chip cover 66 mounted to the first chip carrier 46 and a second chip cover 70 mounted to the second chip carrier 50. The first and second chip covers 66 and 70 cover and protect a plurality of beam steering elements 72 in the form of MMICs and ASICs mounted within the respective chip carriers 46 and 50, as described below. In various implementations, the first and second chip covers 66 and 70 are substantially hermetically sealed to the respective chip carriers 46 and 50. Also, in various embodiments, the first and second chip carriers 46 and 50 are ceramic chip carriers. Additionally, in various forms, each module 14 includes a first guard shim 74 and a second guard shim 78. The first guard shim 74 is attached to the first signal distribution bridge 58 and the signal transfer board 54, thus covering and protecting a connection joint or connection line between the first signal distribution bridge 58 and the signal transfer board 54. Likewise, the second guard shim 78 is attached to the second signal distribution bridge 62 and the signal transfer board 54, thus covering protecting a connection joint or connection line between the second signal distribution bridge 62 and the signal transfer board 54.

The radiator board 42 includes a plurality of RF radiating elements 82 (eight in the exemplary embodiment shown) mounted on a front surface of the radiator board 42. The radiating elements can be single signal or dual signal elements. It will be appreciated that various configurations having widely varying numbers of radiating elements 82 could be constructed as needed to suit specific applications. Thus, single element, dual element or other multiple element configurations are contemplated as being within the scope of the present disclosure. In various embodiments, the radiator board 42 is a multi layer antenna integrated printed wiring board (AiPWB) including a radiating element layer having the radiating elements 82 formed therewith. Additionally, the multi layer radiator AiPWB can include a DC power distribution layer, a digital logic control layer and RF signal distribution layer.

Generally, the beam steering elements 72 process and control RF signals to be emitted by the radiating elements 82, and due to a substantially orthogonal positional relationship, or orientation, between the radiating elements 82 and the beam steering elements 72, described further below, the radiating elements 82 can be located in very close proximity to each other on the radiator board 42. For example, in various forms, the space, or gap, between adjacent radiating elements 82 is one-half wavelength or less, wherein a "wavelength" is equal to the wave length of the highest desired operating frequency of the module 14. Providing such 'tight' spacing of the radiating elements 82 allows the module 14 to operate at high frequencies, e.g., within the KA band, and transmit RF beams having a very high scanning angle without generating grating lobes.

More particularly, the radiator board 42 is substantially orthogonally connected to the top end 26 of the mandrel 22 such that the mandrel 22 extends substantially perpendicularly from a back surface of the radiator board 42. That is, as exemplarily illustrated in FIG. 2, the radiator board 42 generally lies within an X-Y plane and the mandrel 22, and all components attached thereto, extend from the radiator board 42 in the Z-axis direction. The first and second chip carriers 46 and 50 are electrically interconnected to the radiator board 42 and respectively mounted to the first and second sides 34 and 38 of the mandrel 22. Thus, the first and second chip carriers 46 and 50 also extend from the radiator board 42 in the Z direction and have a substantially orthogonal orientation with the radiator board 42.

Figure 4:
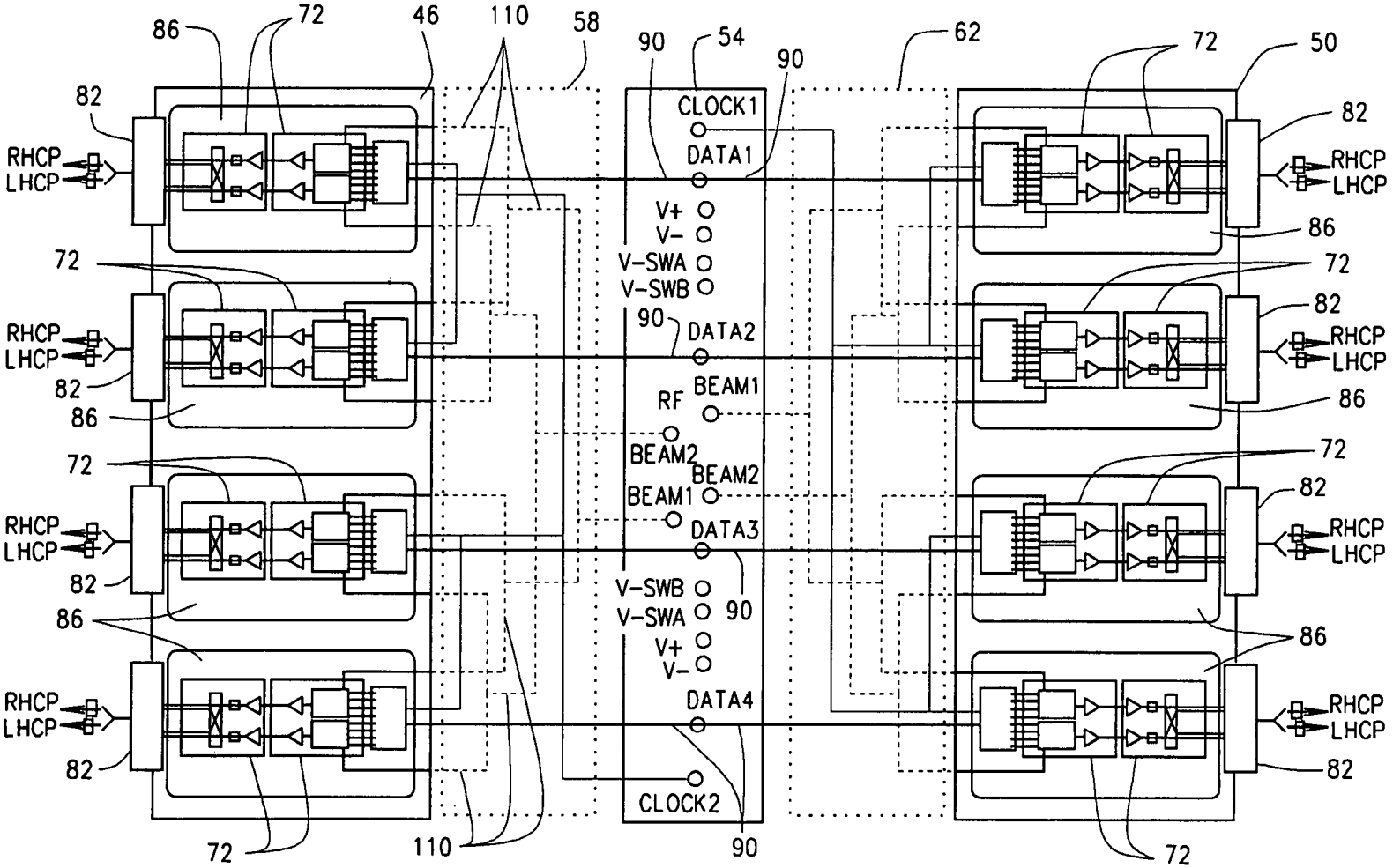
FIG. 4 is a block diagram illustrating the interconnections of various components of each antenna module shown in FIG. 1, in accordance with various embodiments of the present disclosure.
Figure 5:
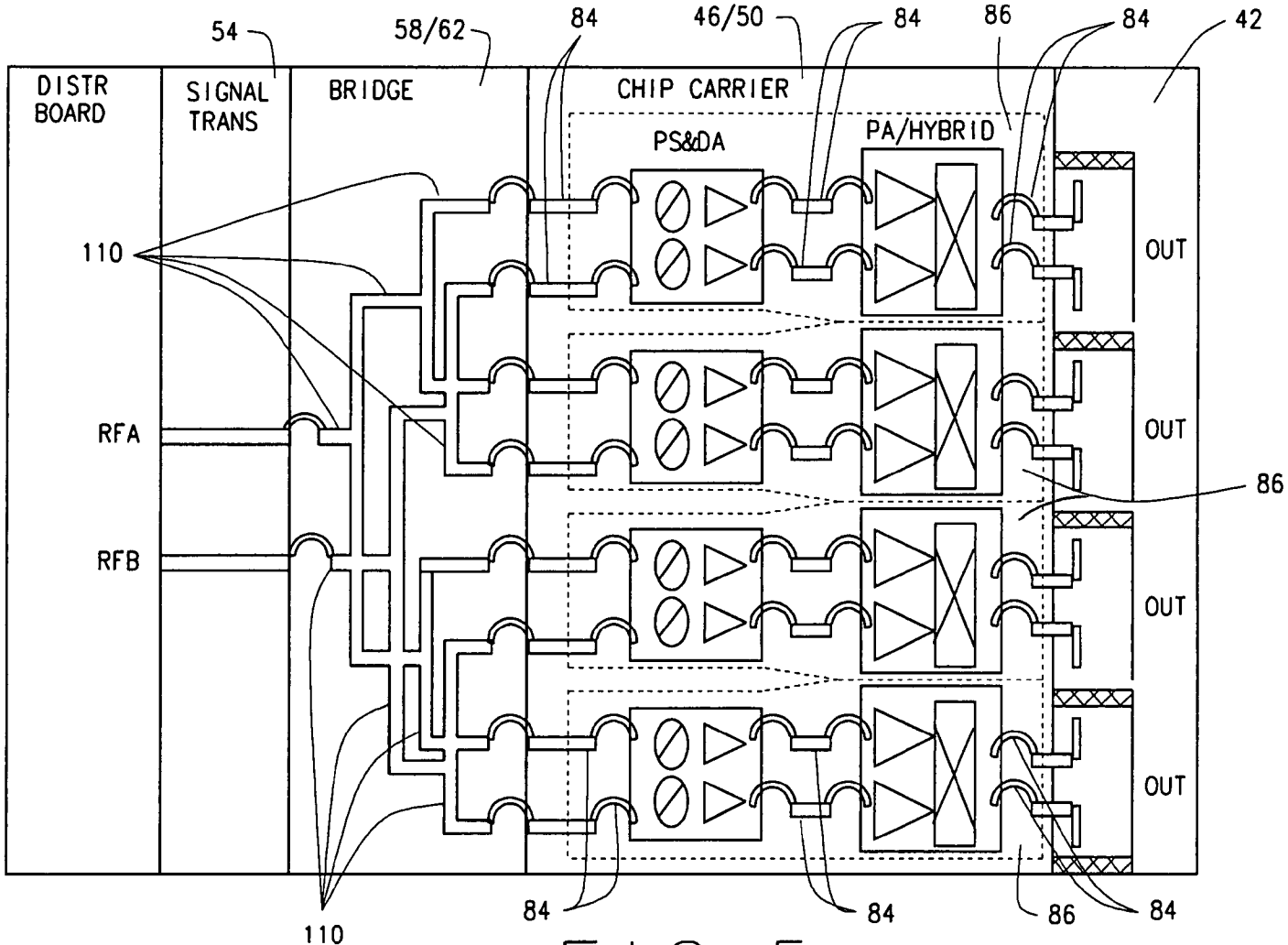
FIG. 5 is a block diagram illustrating the distribution and processing of radio frequency (RF) signals received by each antenna module shown in FIG. 1 from a signal distribution board, in accordance with various embodiments of the present disclosure.

Referring also now to FIGS. 4 and 5, as described above, the first and second chip carriers 46 and 50 include a plurality of beam steering elements 72. Each chip carrier 46 and 50 has formed therewith or etched into a substrate (not shown) of the respective chip carrier 46 and 50 a plurality of integral integrated, monolithic transmission lines and distribution feed lines 84 that interconnect the beam steering elements 72 to form a plurality of beam steering circuits 86 (best shown in FIG. 5). The beam steering elements 72 generally include various monolithic microwave integrated circuits (MMICs) and application specific integrated circuits (ASICs), such as phase shifters, driver amplifiers, power amplifiers, low noise amplifiers, attenuators, switches, etc. Each beam steering circuit 86 is electrically connected to one or more of the radiating elements 82 to process and control RF signals transmitted from and/or received by the respective associated radiating element(s) 82. More specifically, the beam steering circuits 86 of each chip carrier 46 and 50 independently operate to control the beam steering and transmission processing, and/or signal reception processing for at least one radiating element 82. As exemplarily illustrated, each of the first and second chip carriers 46 and 50 includes four separate beam steering control circuits 86 that each control the beam steering and transmission processing, and/or signal reception processing of an independent one of the exemplary eight radiating elements 82. However, in various embodiments, each chip carrier 46 and 50 can include more or fewer beam steering circuits 86 that are associated with, and control beam steering and signal processing of, more than one of the radiating elements 82. For example, in various embodiments, each chip carrier 46 and 50 can include one or more beam steering circuits 86 that are interconnected to and control the beam steering and signal processing of a selected group of two or more radiating elements 82.

As described above, the first and second chip carriers 46 and 40 are mounted to the mandrel 22 such that they have a substantially orthogonal, or perpendicular, orientation with the radiator board 42, and thus, with an aperture of the antenna 10. Accordingly, the beam steering elements 72 also have a substantially orthogonal orientation with respect to the radiator board 42 and the antenna aperture, thus allowing a significant increase in chip attachment area per radiating element 82.

The signal transfer board 54 is mounted on the bottom end 30 of the mandrel 22 and is interconnected with the first and second chip carriers 46 and 50 by the respective first and second distribution bridges 58 and 62. In various embodiments the signal transfer board 54 is a conformable printed wiring board (PWB) including a plurality of integrated, monolithic transmission lines and distribution feed lines 90 that transfer RF and DC signals from a signal distribution board 96 (best shown in FIG. 6) to the first and second distribution bridges 58 and 62. In such embodiments, the signal transfer board 54 includes a flexible substrate, preferably a multi-layer substrate. The signal transfer board 54 is formed to fit around the bottom end 30 of the mandrel 22 providing a first leg 94 that extends partially along the mandrel first side 34 and a second leg 98 that extends partially along the mandrel second side 38.

Figure 6:
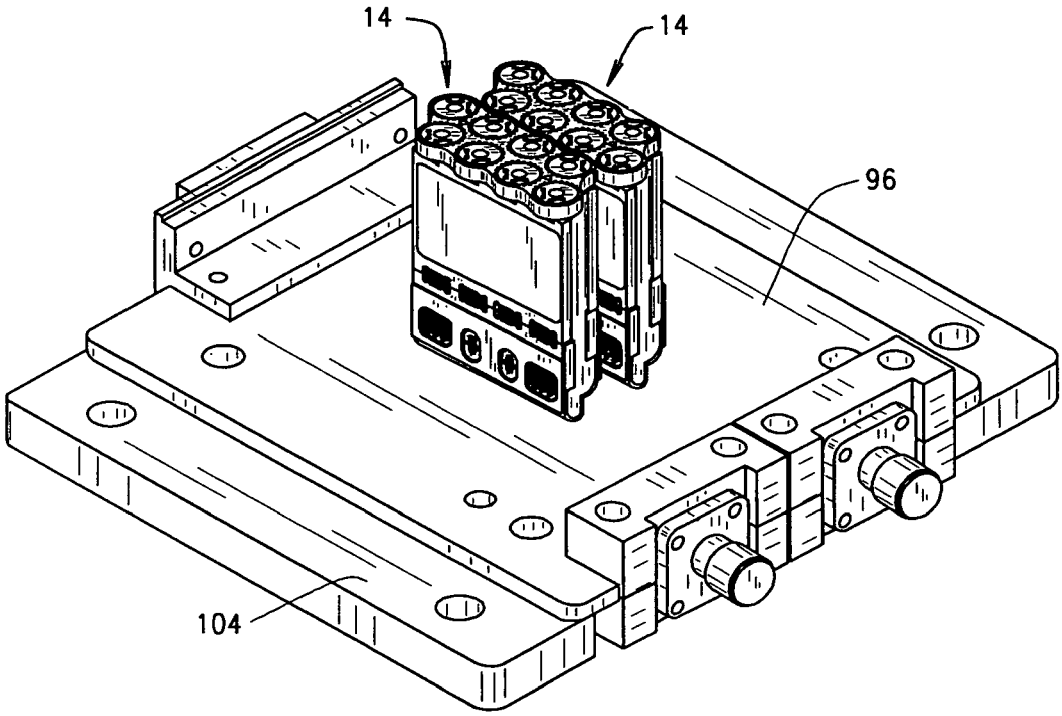
FIG. 6 is a view of the antenna shown in FIG. 1 having various components removed to illustrate an interconnection of the antenna modules to the signal distribution board, in accordance with various embodiments of the present disclosure.

Referring now to FIG. 6, each module 14 is substantially orthogonally mounted to the signal distribution board 96. In various embodiments, the signal distribution board 96 is a multi layer AiPWB that includes a plurality of integrated, monolithic distribution and feed lines (not shown) for distribution of digital, DC and/or RF signals to be communicated to and/or received from each of the modules 14. Each signal transfer board 54 includes a plurality of contact pads (not shown) on a bottom surface adjacent the bottom end 30 of the mandrel 22. Similarly, the signal distribution board includes contact pads (not shown) that are aligned with the signal transfer board 54 contact pads. Accordingly, mounting each module 14 to the signal distribution board 96 compresses, or 'sandwiches', the respective signal transfer board 54 between the mandrel bottom end 30 and a top surface of the signal distribution board, thereby making electrical contact between the contact pads and the integrated, monolithic distribution and feed lines of the signal distribution board 96. Referring now to FIGS. 2, 3 and 6, the mandrel 22 includes one or more threaded mounting posts, e.g., two mounting posts 102, used to mount the respective module 14 to the signal distribution board 96. In various embodiments, the signal distribution board 96 is mounted to a pressure plate 104 (FIG. 6) that prevents the modules 14 from being mounted too tightly to the signal distribution board, which may cause stressing and cracking of the signal distribution board 96, the signal transfer board 54 and/or the electrical contacts therebetween. Each mounting post 102 extends through related apertures **54*a* (FIG. 3) in the signal transfer board 54, the signal distribution board 96 and the pressure plate 104. Nuts are treaded onto the posts to secure the module 14, more particularly the signal transfer board 54, to the signal distribution board 96 having pad-to-pad pressure contact between the signal transfer board 54 and the signal distribution board 96**.

Thus, mounting all of the plurality of modules 14 substantially orthogonally to the signal distribution board 96, as described above, allows RF signals to be transferred between a single signal distribution board, i.e., signal distribution board 96, and each of the modules 14. Furthermore, substantially orthogonally mounting each module 14 to signal distribution board 96 allows the modules 14 to be tightly packed, i.e., each module 14 can be mounted in close proximity to all adjacent modules 14. More importantly, tightly packing the modules 14 allows the radiating elements 82 of adjacent modules 14 to be located in very close proximity to the radiating elements 82 of all adjacent modules 14. For example, in various forms, the space, or gap, between adjacent radiating elements 82 of adjacent modules 14 is one-half wavelength or less, wherein wavelength is equal to the wave length of the highest desired operating frequency of the module 14. Additionally, by tightly packing the modules 14, and therefore the radiating elements 82, in such close proximity to each other, the antenna 10 can be a dual beam, high frequency electronically scanned phased array antenna capable of providing a very wide range of scanning angles. For example, the antenna 10, as described herein, is capable of substantially simultaneously transmitting two independent high frequency radio frequency (RF) beams, e.g., beams of different polarization, having a scanning angle from 0° to approximately 80° without introducing grating lobes at frequencies greater than 25 GHz.

Referring again to FIGS. 2 through 5, the first and second signal distribution bridges 58 and 62 interconnect the signal transfer board 54 with the respective first and second chip carriers 46 and 50. Specifically, in various embodiments, the first and second signal distribution bridges 58 and 62 are each multi layer PWBs including a plurality of integral integrated, monolithic transmission lines and distribution feed lines 110 that divide and distribute RF signals received from signal transfer board 54 to the various beam steering circuits 86. Additionally, the first and second distribution bridges 58 and 62 divide and distribute clock signals and data signals that need to be sorted and fed into each particular beam steering circuit 86. Dividing and distributing the RF, clock and data signals utilizing the first and second signal distribution bridges 58 and 62 eliminates the need for such signal distribution to be performed within the first and second chip carriers 46 and 50. That is, the first and second distribution bridges 58 and 62 allow each beam steering circuit to be independently isolated within the respective first and second chip carriers 46 and 50, thereby simplifying operation, testing and repair of the module 14. The first and second signal distribution bridges 58 and 62 can be interconnected to the signal transfer board 54 and the respective first and second chip carriers 46 and 50 using any suitable electrical connection. For example in various embodiments, the first and second signal distribution bridges 58 and 62 are wire bond connected to the signal transfer board 54 and the respective first and second chip carriers 46 and 50. Similarly, the first and second chip carriers 46 and 50, and thus the beam steering circuits 86, can be interconnected with the radiator board 42 using any suitable electrical connection. For example, in various embodiments, the first and second chip carriers 46 and 50, and thus the beam steering circuits 86, are wire bond connected, e.g., 90° wire bond connected, to the radiator board 42.

As described above, the first and second chip covers 66 and 70 are mounted to the respective first and second chip carriers 46 and 50 to cover and protect the beam steering elements 72. Additionally, the first and second chip covers 66 and 70 can provide electrical insulation and electromagnetic interference isolation, i.e., EMI protection, for each module 14. The first and second guard shims 74 and 78 are attached to the first and second distribution bridges 58, 62 and the signal transfer board 54. More particularly, the first guard shim 74 covers the interconnections, e.g., the wire bond connections, between the first chip carrier 46 and the signal transfer board, e.g., the first leg 94 of the signal transfer board 54. Similarly, the second guard shim 78 covers the interconnections, e.g., the wire bond connections, between the second chip carrier 50 and the signal transfer board, e.g., the second leg 98 of the signal transfer board 54. Thus, the guard shims 74 and 78 protect the interconnections during handling, installing and maintenance of the respective module 14. The guard shims 74 and 78 can be attached to the first and second signal distribution bridges 58 and 62, and signal transfer board 54, using any suitable attachment means. For example, the guard shims 74 and 78 can be epoxied to the upper ground surfaces of first and second signal distribution bridges 58 and 62, and signal transfer board 54. In addition to protecting the interconnections during handling, installing and maintenance, the guard shims 74 and 78 can provide extra grounding that helps isolate the RF signals being transmitted between the signal transfer board and the first and second signal distribution bridges 58 and 62.

The architecture described herein provides a compact dual-beam phased array module 14, which can be used in wide scan, high-frequency electronically-scanned antenna applications. The advantage of the module is that it combines the functionality of a plurality of antenna radiating elements 82, e.g., eight, into a single, dual-beam module, significantly reducing the parts count relative to a single element module. In addition, uniform, half-wavelength or less spacing can be maintained between radiating elements 82 and the modules 14, thereby optimizing the wide-angle beam-steering performance of the electronically-scanned antenna 10.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A dual beam electronically scanned phased array antenna module comprising:

a support mandrel having first and second opposing ends, and first and second opposing sides extending from the first and second opposing ends;

an independent radiator board substantially orthogonally supported on the first opposing end of the mandrel, the radiator board including a plurality of radio frequency (RF) radiating elements;

a pair of chip carriers mounted to the opposing sides of the mandrel and interconnected to the radiator board;

an independent signal transfer board formed to fit around the second end of the mandrel such that the signal transfer board includes a generally U-shape having a pair of opposing legs that extend partially along the opposing sides of the mandrel, and a central portion disposed between the pair of opposing legs;

a pair of signal distribution bridges mounted to the first and second opposing sides of the mandrel and interconnecting the chip carriers with the pair of opposing legs of the signal transfer board to make first and second electrical connections with the pair of opposing legs of the signal transfer board; and an independent signal distribution board adapted to lay over the central portion of the signal transfer board and to physically abut portions of the central portion of the signal transfer board to make physical contact with the signal transfer board, as well as to make a third electrical connection with the signal transfer board.

2. The module of claim 1, wherein the signal distribution board is substantially orthogonally positioned adjacent the second opposing end of the mandrel such that the signal transfer board is compressed between the mandrel and the signal distribution board.

3. The module of claim 1, wherein each said chip carrier comprises a plurality of beam steering elements mounted in and interconnected by the respective chip carrier, the interconnected beam steering elements forming a plurality of beam steering circuits that are each associated with at least one of the radiating elements and adapted to simultaneously transmit two independent high frequency RF signals from the respective radiating elements.

4. The module of claim 3, further comprising a pair of chip covers mounted to the pair of chip carriers to cover, isolate and protect the plurality of beam steering elements.

5. The module of claim 1, further comprising a pair of guard shims attached to the signal transfer board opposing legs and the distribution bridges to cover and protect a plurality of wire bond connections between the signal transfer board and the distribution bridges.

6. The module of claim 1, wherein the radiator board comprises a multi-layer antenna integrated printed wiring board (AiPWB) including a radiator layer comprising the plurality of RF radiating elements.

7. The module of claim 1, wherein the signal transfer board comprises a multi layer conformable substrate including integrated, monolithic transmission and distribution lines.

8. An electronically scanned phased array antenna module comprising:

a support mandrel having opposing sides;

a radiator board substantially orthogonally connected to a first end of the support mandrel, the radiator board including a plurality of radio frequency (RF) radiating elements;

a pair of chip carriers mounted to the opposing sides of the mandrel and interconnected to the radiator board, each said chip carrier comprising a plurality of beam steering circuits, each said beam steering circuit controlling RF signals to be transmitted from at least one of the radiating elements;

an independent signal distribution board positioned substantially orthogonally relative to a second end of the mandrel, for receiving the RF signals to be transmitted by the RF radiating elements;

an independent signal transfer board compressed between the second end of the mandrel and the signal distribution board to lay over a portion of the signal transfer board and to physically and electrically connect the signal transfer board to the signal distribution board, the signal transfer board formed to fit around the second end of the mandrel and adapted to receive signals from the signal distribution board;

a pair of independent signal distribution bridges mounted to the opposing sides of the mandrel and interconnecting the chip carriers with the signal transfer board, the signal distribution bridges adapted to receive the signals from the signal transfer board and distribute the received signals to the plurality of beam steering circuits; and the independent signal transfer board providing three spaced apart points of electrical connection to interconnect the independent signal distribution board with the pair of independent signal distribution bridges.

9. The module of claim 8, wherein each said beam steering circuit comprises a plurality of beam steering elements mounted in and interconnected by the respective chip carrier such that the module is adapted to simultaneously transmit two independent high frequency RF beams.

10. The module of claim 8, wherein the signal transfer board includes a pair of opposing legs that extend partially along the opposing sides of the mandrel and which are wire bond connected to the signal distribution bridges.

11. The module of claim 8, wherein the radiator board comprises a multi layer antenna integrated printed wiring board (AiPWB) including a radiator layer comprising the plurality of RF radiating elements and a layer for at least one of DC power distribution, digital control logic and RF signal distribution.

12. The module of claim 8, further comprising a pair of chip covers mounted to the pair of chip carriers to cover, isolate and protect the plurality of beam steering circuits.

13. The module of claim 8, further comprising a pair of guard shims attached to the signal transfer board and the signal distribution bridges to cover and protect a plurality of wire bond connections between the signal transfer board and the signal distribution bridges.

14. The module of claim 8, wherein the transfer board comprises a multi layer conformable substrate including integrated, monolithic transmission and distribution lines wire bond connected to the signal distribution bridges.

15. The module of claim 8, wherein the distribution bridges comprise a substrate including integrated, monolithic transmission and distribution lines wire bond connected to the chip carriers and the signal transfer board.

16. The module of claim 8, wherein the chip carriers comprise ceramic chip carriers.

17. The module of claim 11, wherein the chip carriers are substantially orthogonally connected to a back surface of the AiPWB via a plurality of substantially 90° wire bond connections.

18. The module of claim 8, wherein the module is adapted to transmit and receive RF signals.

19. An electronically scanned phased array antenna comprising:

a plurality of antenna modules substantially orthogonally connected to a signal distribution board adapted to receive at least one of DC power distribution, digital control logic and radio frequency (RF) signals and distribute the signals to the plurality of antenna modules, each said antenna module comprising:

a multi-layer antenna integrated printed wiring board (AiPWB) including a radiator layer comprising a plurality of RF radiating elements mounted on a front surface of the AiPWB;

a support mandrel substantially orthogonally connected at a first end to a back surface of the AiPWB, and substantially orthogonally connected at an opposing second end to a top surface of the signal distribution board;

a first chip carrier substantially orthogonally interconnected with the AiPWB and mounted to a first side of the mandrel, the first chip carrier including a plurality of beam steering control circuits, each said beam steering control circuit controlling RF signals to be transmitted from at least one of the radiating elements;

a second chip carrier substantially orthogonally interconnected with the AiPWB and mounted to an opposing second side of the mandrel, the second chip carrier including a plurality of beam steering control circuits, each said beam steering control circuit controlling RF signals to be transmitted from at least one of the radiating elements; and a conformable signal transfer board formed disposed around the second end of the mandrel and compressed between the mandrel and the signal distribution board to connect the signal transfer board to the signal distribution board, the signal transfer board adapted to receive RF signals from the signal distribution board and transfer the RF signals to a first signal distribution bridge and a second signal distribution bridge, the first signal distribution bridge mounted to the first side of the mandrel interconnecting the signal transfer board with the first chip carrier for distributing the RF signals received from the signal transfer board to the plurality of beam steering control circuits of the first chip carrier; and the second signal distribution bridge mounted to the second side of the mandrel interconnecting the signal transfer board with the second chip carrier for distributing the signals received from the signal transfer board to the plurality of beam steering control circuits of the second chip carrier.

20. The antenna of claim 19, wherein each said antenna module further comprises:

a first chip cover mounted to the first chip carrier to cover, isolate and protect the plurality of beam steering circuits of the first chip carrier; and a second chip cover mounted to the second chip carrier to cover, isolate and protect the plurality of beam steering circuits of the second chip carrier.

21. The antenna of claim 19, wherein each said antenna module further comprises:

a first guard shim attached to the signal transfer board and the first signal distribution bridge to cover and protect a plurality of wire bond connections between the signal transfer board and the first signal distribution bridge; and a second guard shim attached to the signal transfer board and the second signal distribution bridge to cover and protect a plurality of wire bond connections between the signal transfer board and the second signal distribution bridge.

22. The antenna of claim 19, wherein the antenna is adapted to transmit and receive RF signals.

23. The antenna of claim 19, wherein:

each said beam steering circuit comprises a plurality beam steering elements mounted in and interconnected by the respective chip carrier such that the antenna is adapted to simultaneously transmit two independent, high frequency RF beams; and the antenna modules are orthogonally connected to the signal distribution board so that the radiating elements of adjacent modules have a spacing of at most a half wavelength such that the two substantially simultaneous independent, high frequency RF beams each have a range of scanning angles.

24. The antenna of claim 23, wherein the range of scanning angles includes scanning angles of approximately 0° to 80°.

25. A method for forming an electronically scanned phased array antenna module capable of substantially simultaneously generating two independent, high frequency angle RF beams having a range of scanning angles, said method comprising:

providing a plurality of antenna modules, each said antenna module comprising:

a radiator board substantially orthogonally connected to a first end of a support mandrel, the radiator board including a plurality of radio frequency (RF) radiating elements mounted on a front surface of the radiator board;

a pair of chip carriers mounted to opposing sides of the mandrel and interconnected to the radiator board, each said chip carrier comprising a plurality of beam steering circuits, each said beam steering circuit controlling RF signals to be transmitted from at least one of the radiating elements;

a signal transfer board compressed between the second end of the mandrel and the signal distribution board to connect the signal transfer board to the signal distribution board, the signal transfer board formed to fit around the second end of the mandrel;

a pair of signal distribution bridges mounted to the opposing sides of the mandrel and interconnecting the chip carriers with the signal transfer board, the distribution bridges adapted to receive at least one of DC power distribution, digital control logic and RF signals from the signal transfer board and to distribute the received RF signals to the plurality of beam steering circuits; and substantially orthogonally connecting the plurality of antenna modules to a signal distribution board adapted to receive radio frequency RF signals and distribute the RF signals to the signal transfer boards of the plurality of antenna modules, the plurality of antenna modules substantially orthogonally connected to the signal distribution board in close proximity to each other so that the radiating elements of adjacent ones of the antenna modules have a spacing of at most one-half wavelength, such that the antenna is adapted to substantially simultaneously generate two independent, high frequency RF beams having a range of scanning angles.

26. A dual beam electronically scanned phased array antenna comprising:

first and second, electronically scanned, dual beam antenna modules, with each of the antenna modules comprising:

a support mandrel;

a radiator board supported on a first surface of the mandrel, the radiator board including a plurality of radio frequency (RF) radiating elements able to simultaneously generate dual antenna beams;

a pair of chip carriers mounted to opposing sides of the mandrel, with each of the pair of chip carriers having at least one monolithic microwave integrated circuit (MMIC) chip mounted within its respective said chip carrier and being in electrical communication with the radiator board, the chip carriers each being hermetically sealed;

an independent signal transfer board formed to fit around a second surface of the mandrel;

a pair of signal distribution bridges mounted to the opposing sides of the mandrel and interconnecting the chip carriers with the signal transfer board; and an independent signal distribution board adapted to lay over a portion of the signal transfer board and to make electrical contact with the signal transfer board; and the first and second modules enabling uniform antenna element spacing between all of the radiating elements of both the first and second antenna modules.

* * * * *